United States Patent [19]

Van Deursen

[11] Patent Number: 4,550,840

[45] Date of Patent: Nov. 5, 1985

[54] CLOTHES DRYING DEVICE

[76] Inventor: Aad Van Deursen, 2400 E. Devon, Suite 260, Des Plaines, Ill. 60018

[21] Appl. No.: 580,651

[22] Filed: Feb. 16, 1984

[51] Int. Cl.[4] ..... A47F 5/04; A47F 5/10

[52] U.S. Cl. ..... 211/197; 211/2; 211/119.01

[58] Field of Search ..... 211/197, 196, 205, 2, 211/119.01, 119.15; 135/16, 20 R, 20 M, 25 R, 25 A

[56] References Cited

U.S. PATENT DOCUMENTS

| | | | |
|---|---|---|---|
| 2,616,570 | 11/1952 | Griffin | 211/197 X |
| 2,661,849 | 12/1953 | Spalding | 211/197 X |
| 2,914,188 | 11/1959 | Hansen et al. | 211/119.15 |

FOREIGN PATENT DOCUMENTS

| | | | |
|---|---|---|---|
| 858391 | 12/1952 | Fed. Rep. of Germany | 211/197 |
| 2846772 | 5/1980 | Fed. Rep. of Germany | 211/197 |
| 1334622 | 7/1963 | France | 211/197 |
| 75855 | 10/1949 | Norway | 211/197 |
| 921090 | 3/1963 | United Kingdom | 211/197 |

*Primary Examiner*—Robert W. Gibson, Jr.

[57] ABSTRACT

A portable, collapsible and light weight household device as provided and having a plurality of spider-like arms extending from a mast. The spider assembly can be mounted to the mast with the arms extending upwardly wherein the associated cables may be used to support clothes for drying. If the spider assembly is inverted with the legs pointing in a downward direction, the device can be used as a patio umbrella if covered with a tarp, piece of plastic or the like. Collar members are fitted about the mast and permit the spider assembly to be positioned at any convenient height. A drawstring arrangement allows the spider to be easily folded and unfolded.

10 Claims, 14 Drawing Figures

FIG. 3
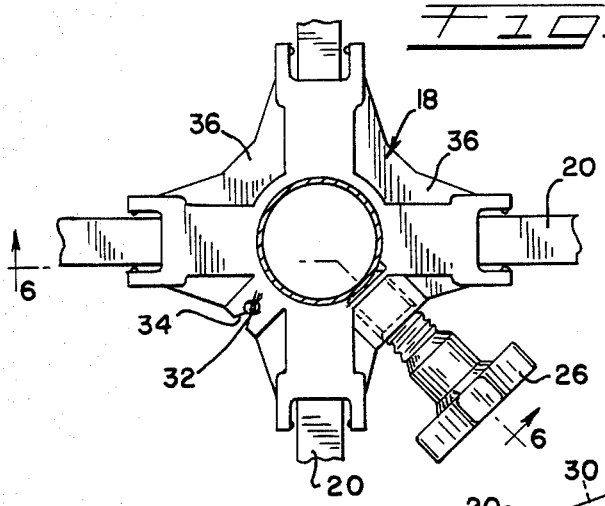
FIG. 4
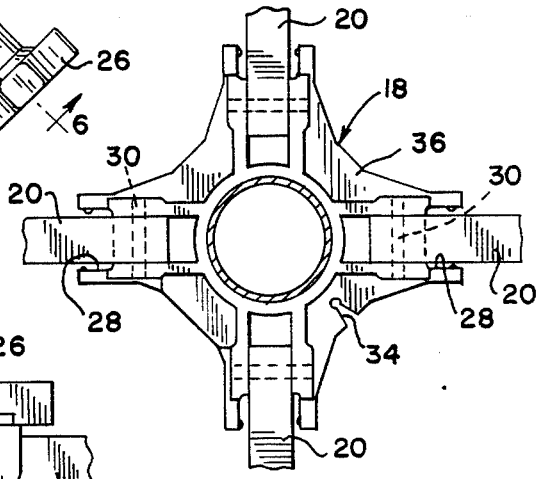
FIG. 5
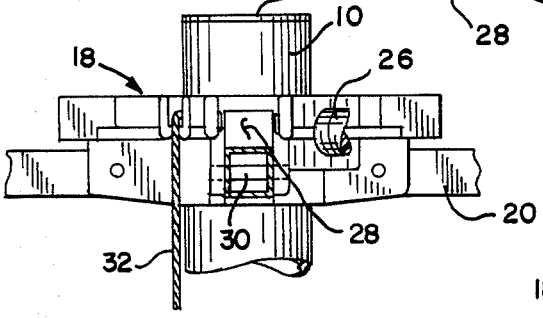
FIG. 6
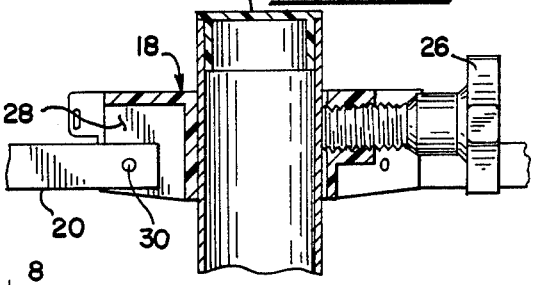
FIG. 7
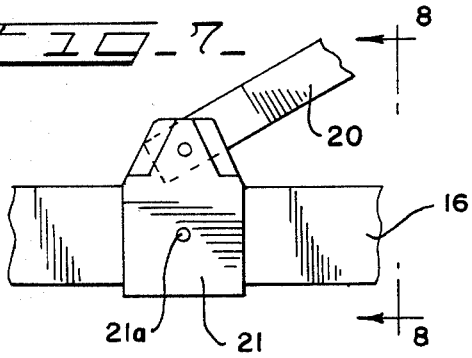
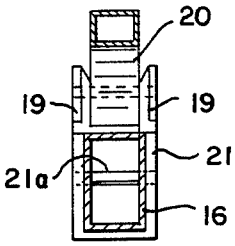
FIG. 8

CLOTHES DRYING DEVICE

BACKGROUND OF THE INVENTION (1) Field of the Invention

This disclosure pertains to household devices and in particular to collapsible clothes dryers which are located outside and used to support wet clothes for air drying. This product can also be used as a patio umbrella by using the clothesline cords to support a tarp, piece of plastic or other opaque material which will block the sun.

(2) Description of the Prior Art

Prior art clothes drying devices generally provide a single upstanding mast having arms extending therefrom and interconnected by clothesline. Some collapsible clothes dryers are shown in the prior art but they are not completely collapsible as is the product disclosed herein. The prior art discloses devices that are all metal which presents certain operational problems with the passage of time due to corrosion. Also, the prior art clothes dryers generally show permanently mounted installation which cannot be dismantled and stored in an out-of-the-way location or transported from place to place.

Problems present with the prior art are overcome by the product disclosed herein which is light weight, completely collapsible and versatile.

SUMMARY

This disclosure pertains to a household device used to dry clothes and which has a second function of being convertible into a patio umbrella or umbrella used by campers and those on picnics to block the sun. The clothes dryer is completely collapsible and portable. A main support mast is provided and is inserted into an associated support tube which is easily pressed into the ground by the user. When positioned in the ground, the support tube then receives the mast and is to hold the mast in an upright position. Once in position, a spider assembly is slipped onto the mast and held in position by upper and lower collars which have lock screws extending therethrough. The lock screws are plastic and have large handles to be easily tightened to grip the mast. After the top or first collar is secured to the mast, the user pulls a drawstring to raise the second collar towards the first, fixed collar causing a spider assembly to open and arms extend outwardly. Once the arms have been extended to a desired position where the attached cords are taut, the second, lower collar is secured by tightening its twist lock. In such a position with arms extending outwardly and upwardly from the mast the device can be used for drying clothes. The clothesline has a high-strength, metal core and plastic coating which is easily cleaned and maintained. The cable extends through each of the arms and is protected by plastic ferrules which are locked into openings in the arms to prevent the cable from being abraded or otherwise damaged.

The arms, associated support links and the mast are made of high-strength aluminum. The collars and other members which attach the metal parts together are constructed of plastic and provide a design in which there are no moving parts in contact at any time. By providing such a design of plastic parts moving on metal the mechanism is insured of operating smoothly even with moisture present. Further, because there are no metal parts in sliding contact, if any oxidation of the aluminum cocurs the operational features of the device will not be impaired because plastic sliding over oxidized aluminum is much more compatible than metal to metal sliding contact.

Features of the device are several and allow the assembled unit to have the versatility of functioning as a clothes dryer and also as an umbrella. Thus the device can be used by campers for not only providing shade when assembled with the arms extending outwardly and downwardly from the mast but the device can also function as a clothes dryer when the arms are extended in the reverse position, that is, extending outwardly and upwardly.

Because the support tube can be easily inserted into the ground and removed it too can accompany the product when used by campers or individuals wishing to transport it, for example, from their primary residence to a summer home or vacation spot.

The mast is hollow aluminum tubing with a top cap which prevents moisture from entering the tube. The support tube also has a cap to prevent moisture from entering when the mast is not in place. The arms and support lengths are tubular aluminum and each outwardly extending arm has an end cap which prevents moisture from entering the arms and also provides a some what rounded non sharp end to prevent injury or inconvenience to the users or those in the area.

It is thus an object of this disclosure to provide a portable household device which can be easily stored and carried by an individual in a folded position and which can be easily unfolded into an operable position for use as a clothes dryer or umbrella.

It is yet another object of this disclosure to show a household device which can be mounted in the ground and includes an upwardly extending mast having a number of outwardly extending arms pivotally attached to a collar member and having link connected near the midportion thereof thus allowing the arms to move from a folded position adjacent the mast to an extended position when associated collar member is moved along the mast.

Yet another object of this disclosure is to provide first and second collars having locking screws with large easily gripped handles which allow the collars to be fixed at various positions along the length of the mast thus customizing a household device to be used by individuals of various heights.

Yet another object of this disclosure is to show a clothes dryer having arms movable from a first folded position to an extended position and having a drawstring and pulley arrangement which allows the device to be automatically unfolded by pulling on the drawstring. These and other objects of the invention will be apparent to those having ordinary skill in the art with reference to the following description, drawings and appended claims.

BRIEF DESCRIPTION OF THE DRAWINGS

FIG. 3 is a top view of the upper collar member;

FIG. 4 is a bottom view of the collar shown in FIG. 3 with portions removed;

FIG. 5 is a front view of the collar shown in FIG. 3;

FIG. 6 is a sectional view taken along lines 6 of FIG. 3;

FIG. 7 is an enlarged view of the connector arrangement joining the outwardly extending arms and attached lengths;

FIG. 8 is a view taken generally along lines 8—8 of FIG. 7;

DESCRIPTION OF THE PREFERRED EMBODIMENT

Figure 1:
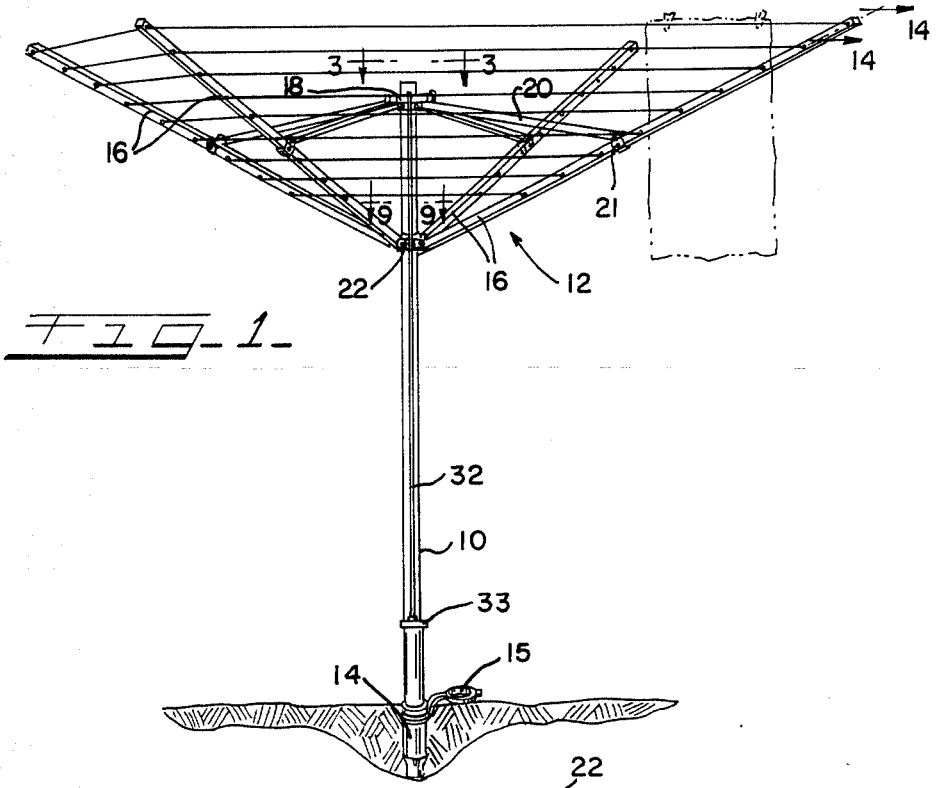
FIG. 1 is an illustration of the device used as a clothes dryer.

Referring now to the drawings and in particular to FIG. 1, there is shown the assembled unit when it is to function as a clothes dryer. The device includes an upwardly extending tubular mast 10 having a top cap 11 (FIG. 6). Attached to the top portion of the mast 10 is a so-called spider assembly. The entire unit may be mounted in a plastic support tube 14 which is easily inserted into the ground and includes a cap 15 which closes off the tube when mast 10 is not inserted therein to prevent moisture, debris and the like from entering the support tube 14.

Spider assembly 12 includes a number of outwardly extending arms 16. The arms are constructed from light weight high-strength aluminum and are closed off at each exposed end with a plastic cap 17. A so-called first collar is designated 18 and attached near the top portion of the mast 10. A number of links 20 are pivotly connected to the first collar 18 and extend outwardly therefrom. The links 20 are pivotly attached at their extended end to a plastic connector block 21 which has upstanding ears 19 and is securely attached to the so called arms 16 by pin zia. A second collar is indicated with the numeral 22 and is also attached to the mast spaced downwardly away from the top collar 18.

Figure 9:
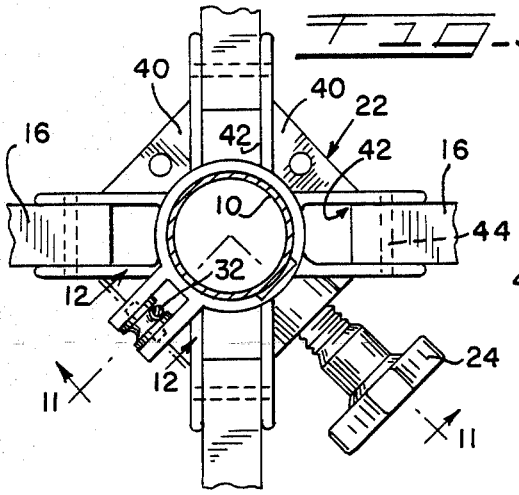
FIG. 9 is a top view of the lower pulley shown in the assembly of FIG. 1.
Figure 11:
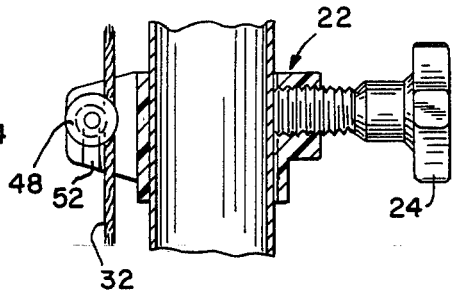
FIG. 11 is a sectional view taken generally along lines 11—11 of FIG. 9.
Figure 10:
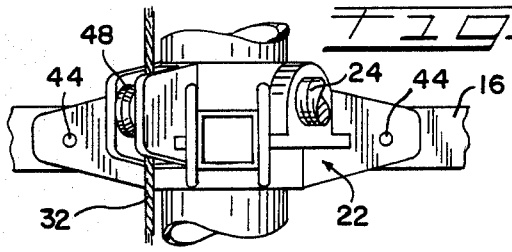
FIG. 10 is an elevational view of the collar shown in FIG. 9.
Figure 12:
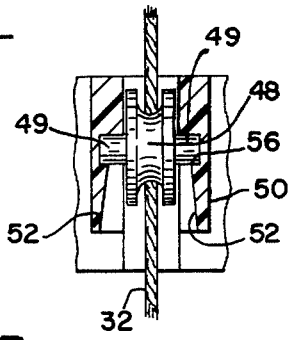
FIG. 12 is an enlarged view of the pulley associated with the collar shown in FIG. 9.
Figure 13:
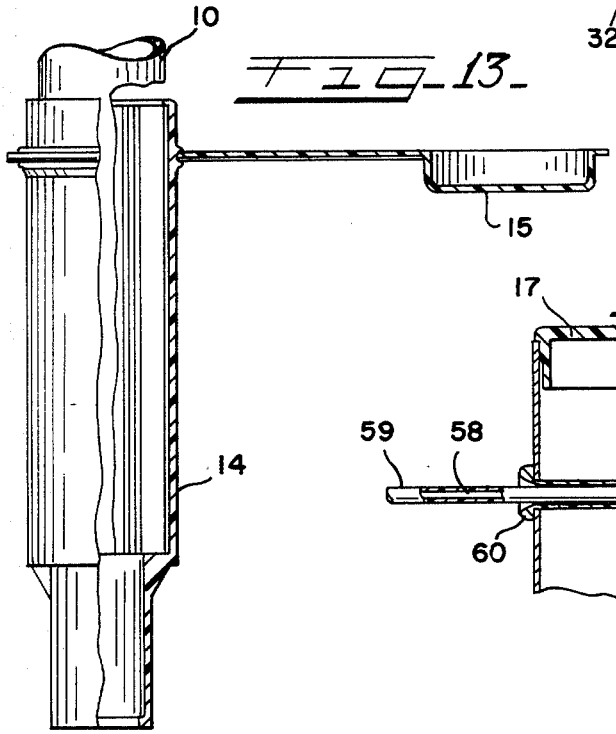
FIG. 13 is an enlarged view of partially in section of the ground-mounted support tube.
Figure 14:
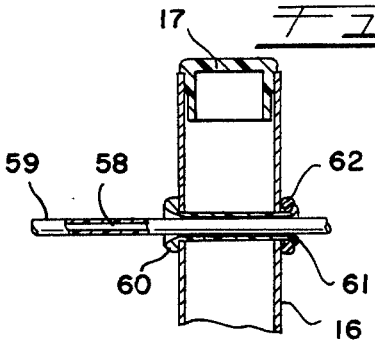
FIG. 14 is an enlarged sectional view showing the support arms and associated cable and cable guide member.

As shown in FIGS. 9–11 the second collar 22 includes a twist lock member 24 having a large handle which can be easily grasped and rotated. The twist lock is threaded into the second collar 22 and when tightened securely fixes the twist lock at any desired location on the mast 10. Similarly, the top collar shown in FIG. 1 also has a twist lock designated by numeral 26 which, like the twist lock 24 includes a large handle and is threaded into the first collar 18 in order that the first collar can be secured located and locked at any desired position.

The collar shown in FIG. 4 includes four oppositely spaced throat openings 28 into which the leg members are located and attached by a hinge pin 30. A drawstring 32 is located in a slot 34 and securely held therein. Each throat portion 28 is interconnected by a rigid gusset 36 which is integrally cast with the collar as a plastic member having great rigidity and strength.

The second collar 22 or the lower collar illustrated in FIG. 1 also includes reinforcing gussets 40 with interconnect throat members 42 into which the arms 16 are pivotly attached with the hinge pin 44. The lower collar or second collar 22 also includes a pulley 48 which is mounted in its own housing which includes a housing 50 having a tapered entry section 52 which is some what flexible and deflects outwardly to allow the pulley bearings 49 to be mounted in the seat designated 56 securely held therein.

Each outwardly extending arm 16 has a number of openings spaced along its length into which wire cable 58 is located. The wire cable 58 has a metallic core and an outer plastic coating 59. Each opening in the arm has a ferrule located therein. Each ferrule 60 is a plastic member having a blunt face at one end and a hook type of locking end 61 which receives a lock ring 62 to securely hold the ferrule in the opening of the arm 16. The ferrules are made of plastic and provide a smooth surface for the cable to be attached into to prevent the cable from being damaged or nicked and thus increase the useful life of the cable.

With the construction just described, it is anticipated that when the device is used for drying clothes as shown in FIG. 1 the unit would be mounted in a stored position with the lower collar 22 positioned below the location shown in FIG. 1. In such a position the arms 16 would be extending upwardly and located adjacent the mast 10. Also, in such a configuration the lock screw 24 would be loosened. To unfold the assembly the user merely grasps the handle 33 of the drawstring 32 and pulls it outwardly at right angles to the mast 10. When such action occurs the pulley 48 causes the lower collar 22 to move upwardly on the mast 10. The drawstring is pulled taut and when the unit is unfolded into the desired position the twist lock 22 is turned to lock the second collar securely in position. Thus it is seen that an individual can easily unfold the unit from a stored position into a useful position. By simply reversing the procedure and unlocking the twist lock 24 the user merely urges the second collar 22 downardly and the arms will fold into position adjacent the mast 10.

Figure 2:
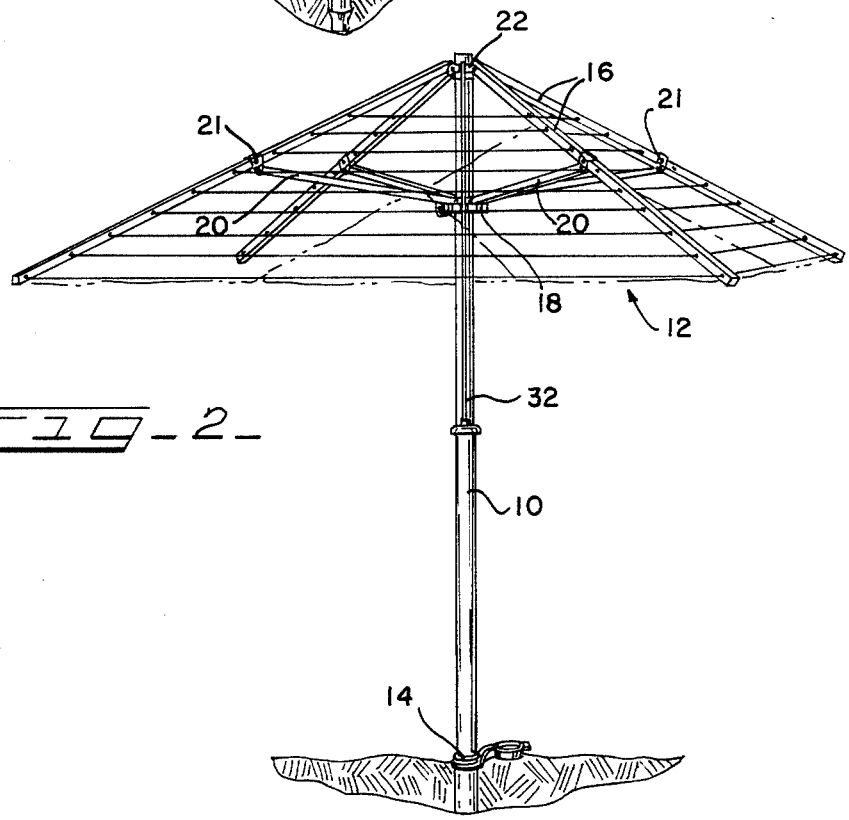
FIG. 2 is an illustration of the device showing it as an umbrella.

As shown in FIG. 2, when the device is to be used as an umbrella or in the inverted position even to be used for drying clothes, the collar 22 is located at the top of the mast and the first collar 18 is spaced there below. To fold the unit from the extended position of FIG. 2 the user merely grasps the twist lock 26 associated with the collar 18, loosens it and moves it downwardly along the mast, causing the arms to fold downwardly and inwardly into position adjacent and generally parallel with the mast 10.

Thus it is shown that the unit as provided is constructed of durable plastic collar members which is easily operated by one person and provides a dual function of being capable of use as a clothes dryer and/or umbrella.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A portable household device which can be easily stored and carried by an individual when in a folded position, and, which is moveable to an unfolded, operable position for use as a clothes dryer and umbrella, the improvement comprising:

a ground mounted mast having a bottom in the ground and having a top and being adapted to be secured in an upright position;

a spider mechanism;

said spider mechanism including a top collar and a bottom collar, each collar being attached to said mast and spaced thereapart, each collar having adjustment and locking means for selectively securing and also varying the position of each collar on said mast;

a plurality of support arms extending from said bottom collar and having a pivotal attachment with the bottom collar for swinging motion between a substantially vertical position adjacent said mast when stored to an operational position;

cable means extending between and connecting said support arms;

said support arms having a plurality of openings with plastic ferrules providing smooth passageways for said cable means to thereby allow the cable to move easily therethrough said plastic ferrules including a first insert portion having an integral head formed therein and having a hooked end spaced from the head;

a lock ring located about the hooked end adjacent the support arm to capture the ferrule in the associated opening of the support arm;

a plurality of connecting links having one end attached to and extending from the top collar and having a pivotal attachment connection with the top collar to provide swinging movement of said links between a first position adjacent the mast when the device is folded, to a second position away form the mast when the device is unfolded, said connecting links having a second end with a pivotal attachment with an associated support arm; and said top and bottom collars having mast gripping means being adjustable to unlock to allow movement of said collars on said mast for selectively positioning the spider mechanism and said mast whereby the spider may be positioned with said support arms extending upwardly and outwardly of said mast and thereby placing said connecting links in a state of tension, and said collars capable of being reversed on said mast whereby said support arms extend downwardly and outwardly of said mast and said connecting links are placed in a state of compression and the device can also be utilized with cover means as said umbrella and a clothes dryer.

2. The household device of claim 1, wherein said cable means comprises:

a continuous cable member:

a central metal core to impart high strength to said cable means and prevent stretching and;

an outer plastic coating covering said core and providing a smooth outer surface which can be easily cleaned.

3. The household device of claim 1, and:

said collars being slidabley mounted on said mast to provide for removal and repositioning of said spider mechanism to locate the support arms to extend outwardly and downwardly of the mast.

4. The household device of claim 3, and:

cover means extending about and covering the support arms when in said downwardly extending position and said cable means supporting the cover to thereby provide an umbrella effect for providing shade and protection from the elements.

5. The household device of claim 1 wherein said adjustment and locking means comprises:

plastic threaded means extending through the collar means and having a locking end for contacting said mast as the threaded means is turned;

a large, plastic twist lock handle connected with the threaded means and having gripping means which may be easily grasped by the user.

6. The household device of claim 1, and:

a support tube having an opened end to receive said mast and having an end with means adapted to be inserted into the ground and securely hold the mast in an upright position;

said support tube having a one piece thermoplastic construction to be impervious to water and dampness.

7. The household device of claim 6, and said support tube further including:

a cap adapted to fit snugly over the open end of the support tube to keep out rain, dust and debris when the mast is not in position.

8. The household device of claim 1 and:

plastic connector members surrounding said support arms near the mid portion and comprising plastic members joined to the associated support arm with a connecting pin, and, said connector members having upstanding ears with the hinge pin for attachment of one end of an associated connecting link

9. The household device of claim 1, and:

said spider mechanism having four support arms and four associated connecting links attached to both said support arms and top collar when it is desirable to have support arms extend outwardly and upwardly of the mast;

each collar being a one piece plastic molded member having four U-shaped throats to thereby provide a sturdy collar for securely attaching and holding in place the support arms and connecting links when the adjustment and locking means are tightened.

10. A portable household device which can be easily stored and carried by an individual when in a folded position, and, which is moveable to an unfolded, operable position for use as a clothes dryer and umbrella, the improvement comprising:

a ground mounted mast having a bottom in the ground and having a top and being adapted to be secured in an upright position;

a spider mechanism;

said spider mechanism including a top collar and a bottom collar, each collar being attached to said mast and spaced thereapart, each collar having adjustment and locking means for selectively securing and also varying the position of each collar on said mast;

said bottom collar including a pulley having bearings;

a drawstring extending over said pulley and having a handle at one end and the other end having means attached to the top collar whereby after securing the top collar to the mast, the bottom collar is slidingly mounted about the mast, to allow the drawstring to be pulled to raise and lower the bottom collar to move the device from said folded to unfolded position;

a pulley housing having a flexible tapered entry section which deflects outwardly as the pulley is inserted;

seat means to receive the pulley bearings and securely hold same;

a plurality of support arms extending from said bottom collar and having a pivotal attachment with the bottom collar for swinging motion between a substantially vertical position adjacent said mast when stored to an operational position;

cable means extending between and connecting said support arms;

a plurality of connecting links having one end attached to and extending from the top collar and having a pivotal attachment connection with the top collar to provide swinging movement of said links between a first position adjacent the mast when the device is folded, to a second position away form the mast when the device is unfolded, said connecting links having a second end with a pivotal attachment with an associated support arm; and said top and bottom collars having mast gripping means being adjustable to unlock to allow movement of said collars on said mast for selectively positioning the spider mechanism and said mast whereby the spider may be positioned with said support arms extending upwardly and outwardly of said mast and thereby placing said connecting links in a state of tension, and said collars capable of being reversed on said mast whereby said support arms extend downwardly and outwardly of said mast and said connecting links are placed in a state of compression and the device can also be utilized with cover means as said umbrella and a clothes dryer.

* * * * *